US005216779A

United States Patent [19]

Glenn, III

[11] Patent Number: 5,216,779

[45] Date of Patent: Jun. 8, 1993

[54] UPRIGHT SOFT BAG TYPE VACUUM CLEANER

[75] Inventor: William K. Glenn, III, Anderson, S.C.

[73] Assignee: Ryobi Motor Products Corp., Easley, S.C.

[21] Appl. No.: 819,399

[22] Filed: Jan. 10, 1992

[51] Int. Cl.[5] ..... A47L 9/10

[52] U.S. Cl. ..... 15/351; 15/410; 55/368; 55/371; 55/376; 55/380

[58] Field of Search ..... 15/350, 351, 410; 55/368, 371, 376, 380, 473

[56] References Cited

U.S. PATENT DOCUMENTS

| | | | |
|---|---|---|---|
| 1,264,989 | 5/1918 | Stecker | 55/368 |
| 1,962,370 | 6/1934 | Thor | 15/351 X |
| 2,135,927 | 11/1938 | Voorhees | 55/368 |
| 3,150,405 | 9/1964 | Tissler | 15/351 |
| 3,350,858 | 11/1967 | Verhagen | 15/350 X |
| 3,728,847 | 4/1973 | Howard et al. | 15/350 X |
| 4,249,280 | 2/1981 | Goodrich | 15/410 X |
| 4,467,493 | 8/1984 | Buchtel | 15/410 X |
| 4,566,884 | 1/1986 | Jones et al. | 15/350 X |
| 4,621,390 | 11/1986 | Hampton et al. | 15/351 |
| 4,720,887 | 1/1988 | Bosyi et al. | 15/351 |

*Primary Examiner*—Stephen F. Gerrity
*Attorney, Agent, or Firm*—Brooks & Kushman

[57] ABSTRACT

An upright vacuum cleaner having a filter bag housing assembly comprised of a fabric or otherwise flexible and air permeable bag housing resiliently supported at its bottom end relative to the operator handle such that the bag housing is always in tension and is prevented from twisting about the axis of the operator handle. The bag housing assembly includes rigid upper and lower frame members thereby maintaining the assembly in a prescribed geometric shape. The lower frame member which defines the bottom of the bag housing includes a pair of laterally disposed elongated track members telescopically disposed within respective guide track members fixed to the handle and resiliently biased relative to the respective guide track member to thereby maintain the bag housing in tension and provide lateral stability to the bag housing at the same time.

9 Claims, 4 Drawing Sheets

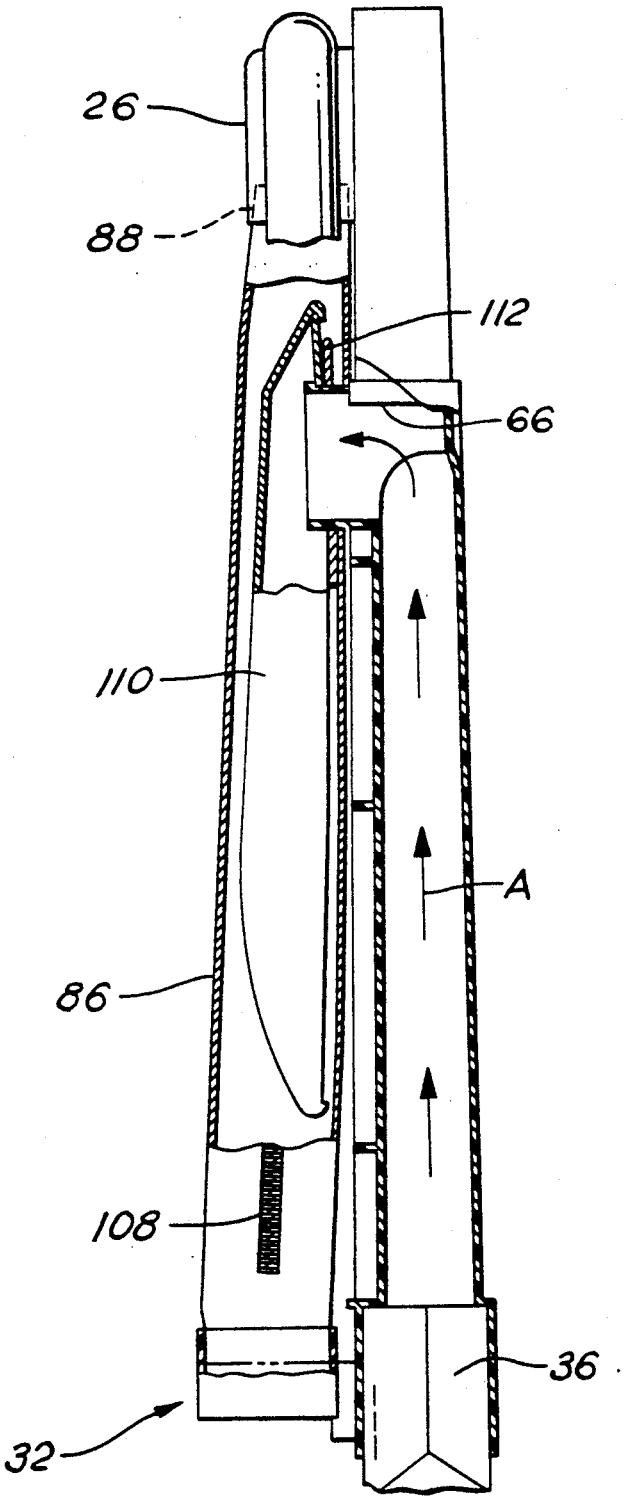
fig-4
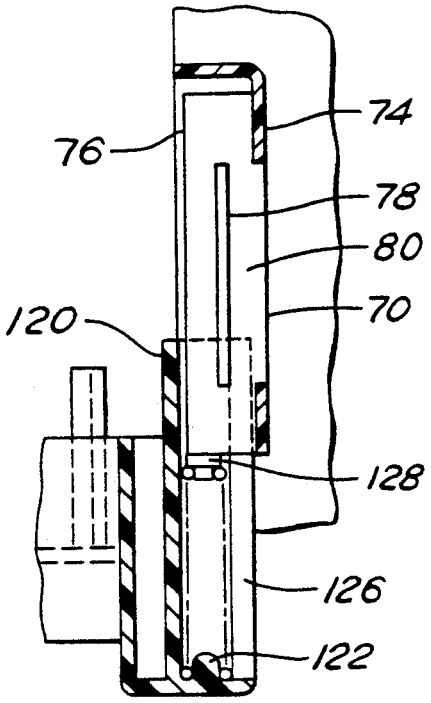
fig-5
fig-6
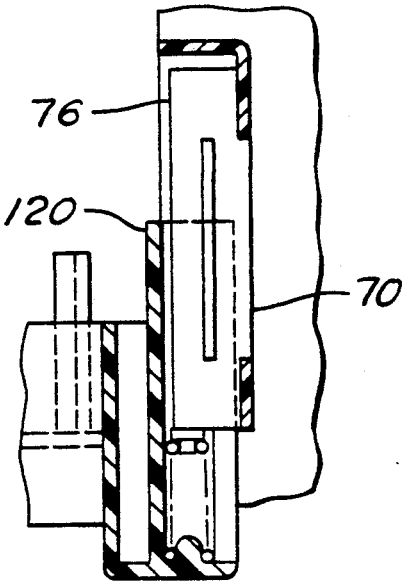

UPRIGHT SOFT BAG TYPE VACUUM CLEANER

TECHNICAL FIELD

This invention relates to vacuum cleaners, particularly those adapted for household and light industrial use and being of the upright type.

BACKGROUND ART

Upright vacuum cleaners are a particularly popular type of vacuum cleaner for household and light industrial vacuum cleaning of floors and floor carpeting. Typically, the unit includes a cleaner head assembly mounted on wheels and having a suction generator driven by a motor, with the motor also providing a belt drive for the roller-type agitator or roller brush mounted on the chassis. The unit also includes an operating handle pivoted to the chassis which can be placed in a lower inclined position to assist the operator in moving the vacuum cleaner over the carpet and in an upright position whereby the vacuum cleaner can be conveniently stored in a closet or the like thereby occupying minimal space. A filter bag is generally mounted on the handle within a hard case or a flexible fabric bag with the filter bag communicating with a passageway at the positive pressure end of the suction generator or fan assembly to collect the dirt-laden air brought up from the floor or carpet. The handle may also carry a storage rack for the electric cord providing power from a wall outlet to the suction generating motor means.

In upright vacuum cleaners utilizing a flexible fabric bag housing for enclosing the filter bag, it is most common to fix the bottom of the fabric housing to the lower end of the handle or chassis and suspend the top of the bag from a coil spring which will maintain tension on the bag and hold it in the upright position. The bag includes a zipper running its length to provide access within the bag housing for installing and withdrawing a filter bag. The filter bag is arranged with the inlet port secured to the chassis at the discharge end of the suction generator or fan such that the opposite end of the bag is elevated and the dirt-laden air. As a result, the dirt-laden air being discharged into the bag will fill the bag from the bottom up and require passing the discharge air through the dirt collected at the bottom of the bag. This can create a fair amount of back pressure in the vacuum cleaner and result in frequently having to replace the filter bag in order to maintain the vacuum cleaning efficiency of the vacuum cleaner.

More recently, upright vacuum cleaners have been designed to provide an air discharge duct extending lengthwise up the handle from the discharge end of the suction generating fan within the chassis and discharging the air at the upper end of the handle. With such an arrangement, the bag is suspended from a filter bag holding bracket positioned at the discharge end of the duct so that the bag hangs with its inlet port at the top of the bag and the dirt-laden air is blown from the top to the bottom of the bag where the dirt collects as the discharge air passes through the air permeable filter bag. This type of vacuum cleaning unit has been available with a soft bag housing, as described above, and, alternatively, with a "hard case", namely an all plastic housing of generally rigid construction in the shape of an elongate box.

With the hard case design, a front cover plate is provided, also of plastic construction, which may be hinged at the bottom and provided with a retainer clip for closing the top end of the front panel. The overall appearance is quite streamlined, thus being aesthetically pleasing to the user. Also, due to its rigidity, the filter bag within its closure remains virtually undisturbed.

Nevertheless, the flexible fabric bag housing offers certain advantageous design features over that of the hard case, including light weight, ease of use, savings in material cost, and aesthetic design alternatives.

SUMMARY OF THE INVENTION

The present invention contemplates an upright vacuum cleaner filter bag housing assembly comprised of a fabric or otherwise flexible and air permeable bag housing resiliently supported at its bottom end relative to the operator handle such that the flexible bag design may be used with units which suspend a filter bag from an upper inlet port and force dirt-laden air down into the bag.

The invention further contemplates a means of resiliently suspending a flexible air permeable filter bag housing from the operator handle in such a manner that the bag is prevented from twisting about the axis of the operator handle.

The invention also contemplates a fabric filter bag housing assembly suspended from an operator handle in the vacuum cleaning unit in such a manner that the bag housing is under constant tension and thereby retains a particular predetermined exterior configuration.

The invention further contemplates a bag housing assembly as described immediately above wherein the predetermined configuration is determined by rigid upper and lower frame members in a prescribed geometric shape, with the lower frame member defining the bottom of the bag housing and including a pair of laterally disposed elongated track members which may be resiliently biased relative to the handle to thereby maintain the bag housing in tension and provide lateral stability to the bag housing at the same time.

The above objects, features, and advantages of the present invention, as well as others not specifically mentioned, are readily apparent from the following detailed description of the best mode for carrying out the invention when taken in connection with the accompanying drawings.

BRIEF DESCRIPTION OF THE DRAWINGS

FIG. 4 is an elevation view of the vacuum cleaner taken basically along the section lines 4—4 of FIG. 3 and showing a filter bag in place within the bag housing assembly;

FIG. 5 is an elevation view of the bag housing resilient suspension assembly in accordance with the present invention and taken along section lines 5—5 of FIG. 3 and showing the bag housing assembly in an extended position;

FIG. 6 is a view similar to FIG. 5 and showing the bag housing assembly in a retracted position;

BEST MODE FOR CARRYING OUT THE INVENTION

Figures 1, 2:
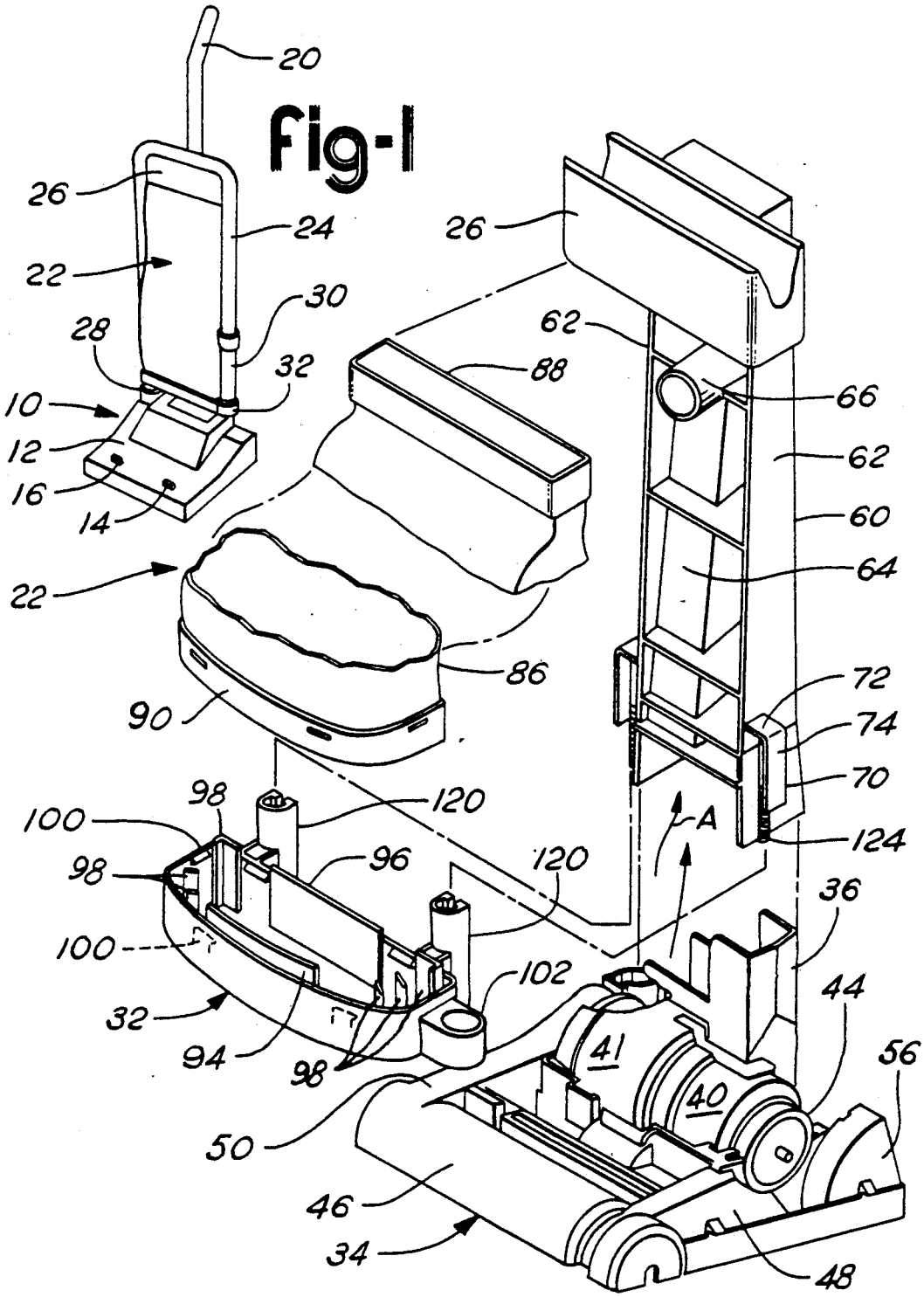
FIG. 1 is an overall perspective view of the vacuum cleaner assembly in accordance with the present invention.
FIG. 2 is an exploded perspective view of the vacuum cleaner unit and showing particularly the structure of the bag housing assembly and operator handle in accordance with the present invention.

As seen in FIG. 1, the upright-type vacuum cleaner of the present invention includes a vacuum cleaning head assembly, generally designated 10, and having a hood 12. The hood carries two adjusting levers or knobs 14,16, with the one knob 14 being manually adjustable for adjusting the height of the agitator or roller brush from the floor and the other knob or adjustment lever 16 being manually adjustable to close off the suction passage to the agitator or roller brush when the vacuum cleaner assembly is to be used for off-the-floor suction operation, all of which is described below in detail.

The vacuum cleaner includes an operator handle 20 pivoted to the cleaner head assembly in a conventional manner, and carrying a filter bag assembly 22 and an off-the-floor suction attachment hose 24. The attachment hose is supported on a rest 26 and is secured to the cleaner head assembly at a hose inlet end 28 and adapted to be wrapped around the bag housing assembly from the inlet end to a point securing the nozzle end 30 within a lower frame member 32 of the bag housing.

Figure 3:
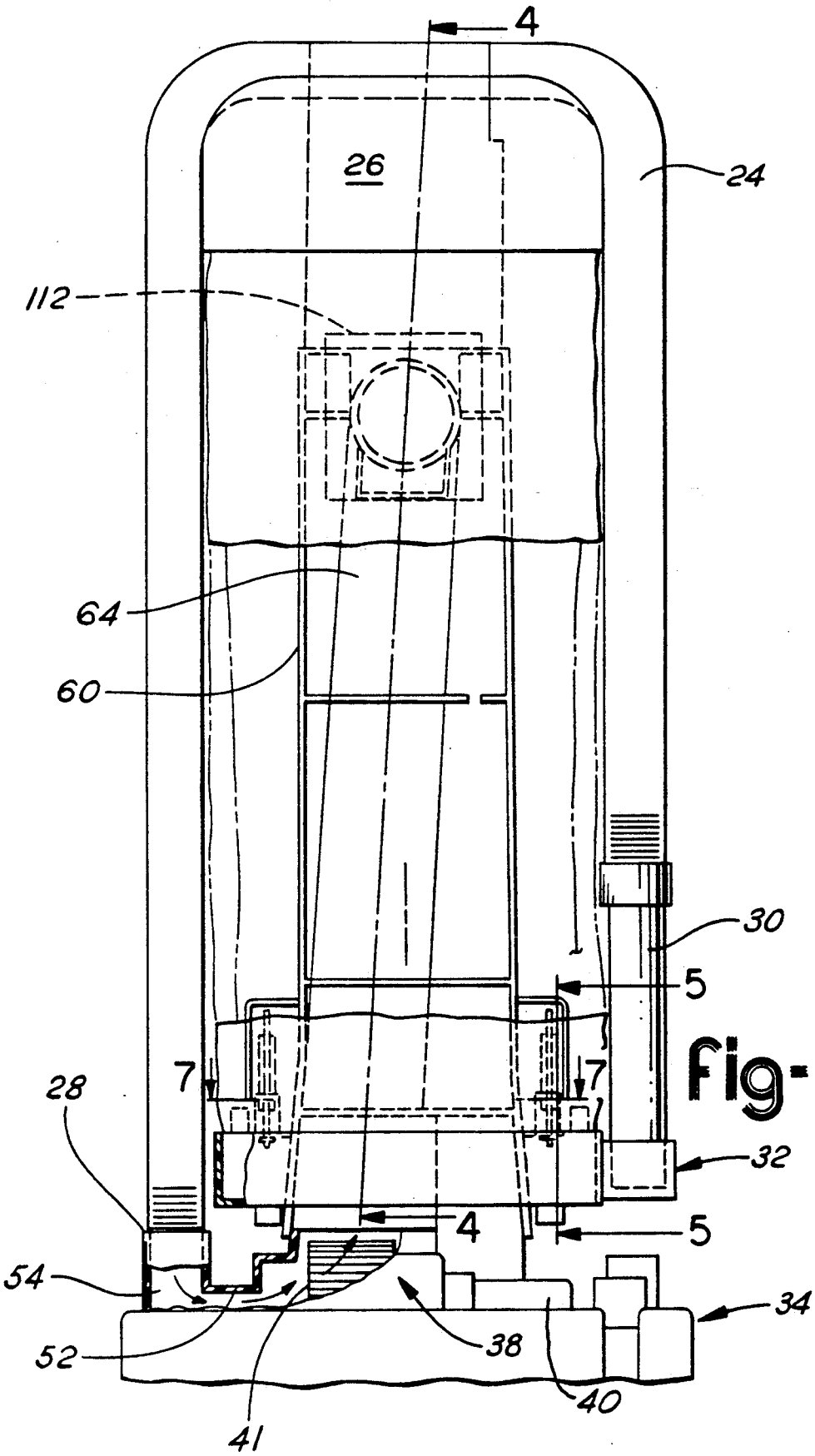
FIG. 3 is a front view of the vacuum cleaner in accordance with the present invention, but without the hood on the chassis, and showing portions of the chassis and lower bag housing assembly in cross-section.

As shown basically in FIGS. 2 and 3, the cleaner head assembly 10 is seen to include an injection molded plastic chassis 34. The operator handle is secured to a bracket portion 36 which carries the suction-generating means of the vacuum cleaner, namely a motor/fan assembly generally designated 38, and including a motor 40 at one end and a fan 41 at the opposite end. The fan is enclosed within a fan housing 42. The bracket 36 and integral motor/fan assembly 38 are pivotally journalled on the chassis at journals 44. At its forward end, the chassis includes a semi-cylindrical chamber housing 46 which is adapted to receive the agitator or roller brush which rotates about an axis extending transversely at the cleaner head assembly. The agitator is adapted to be driven by a belt provided within a belt housing 48 and providing drive from a drive pulley at one end of the motor to a driven pulley affixed to the axle of the agitator. At its opposite end, the chamber 46 is in open communication with a passageway 50 that leads to the inlet end of the suction generating fan. At the same inlet end 52, there is provided an inlet port 54 for the suction attachment hose 24. At the discharge end of the fan, the air is discharged through the bracket 36 in the direction of the arrow designated A. Thus, the interior portion of the bracket forms an air discharge tube.

Finally, as to the chassis 34, it is adapted to be supported on front and rear casters, with the rear casters being located within the caster housing 56. None of the front and rear casters or agitator, nor a mechanism for adjusting the height of the chassis relative to the floor, as controlled by adjusting knob 14, nor the alternate suction directing mechanism closing off chamber 46 from the inlet to fan 41 as adjusted by the adjustment knob 16, is shown since it forms no part of the present invention. For further details, reference may be made to applicant's co-pending patent application Ser. No. 819,394, filed concurrently with the present application, and the subject matter of which is incorporated herein by reference.

Figure 7:
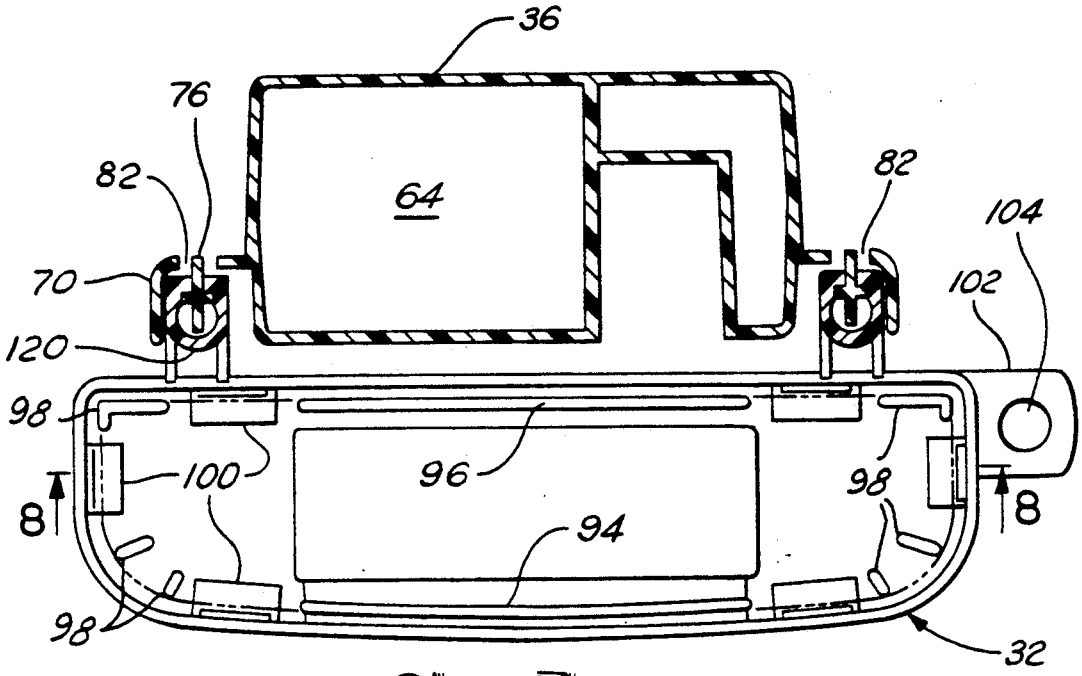
FIG. 7 is a plan view of the bag housing assembly taken along the section lines 7—7 of FIG. 3 and showing the details of the bag housing lower frame member.
Figure 8:
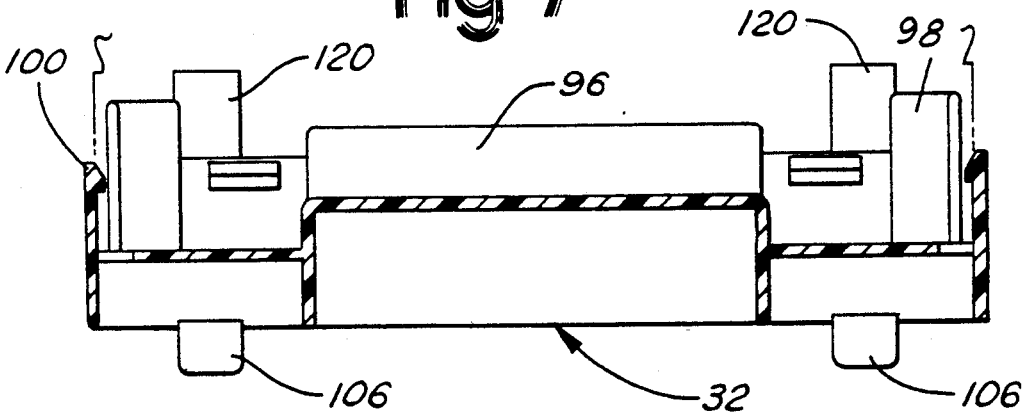
FIG. 8 is a front view of the bag housing assembly at the lower bag housing frame member and taken along section lines 8—8 of FIG. 7.

As seen in FIGS. 2–4, the operating handle 20 includes a lower member 60 which is basically rectangular in cross-section and includes a pair of laterally spaced walls 62 adapted to slip over and snugly receive the bracket 36. Fasteners (not shown) secure the handle member 60 to the bracket 36. Within the interior of the member 60 is located an air discharge tube 64 through which the dirt-laden air as indicated by the arrow A is directed to a discharge end 66 which also constitutes the filter bag inlet port. Affixed to the top of the member 60 is the attachment hose support member 26. At the bottom of the member 60 is located, on each wall 62, a bag housing tensioning guide track member 70 in the form of an elongate, rectangular tube having a base 72 and side walls 74. Looking at FIG. 7, each track member is seen to include an interior guide rib 76 projecting from the rear side wall 74 and being T-shaped in cross-section in the plan view to provide guide ribs 78 and 80. Rear side wall 74 also includes a window slot 82 for viewing the relative position of the follower track member 120 within the guide track, as described below.

The flexible air permeable bag housing assembly, generally designated 22, is also shown in FIGS. 2 and 4 and includes a fabric bag 86 having secured at its upper end an upper retainer band 88. Upper retainer band 88 is permanently secured and nested within the lower portion of the hose support member 26, so that the two members have the appearance of being a unitary structure. At the lower end of the bag, there is provided a retainer band 90. Each retainer band 88,90 is relatively rigid but deformable or flexible so that it will generally conform to the shape of the respective rest 26 and lower frame member 32 within which each is to be secured. Thus each band is preferably a plastic belt wrapped about the entire circumference of the bag and stitched or glued or otherwise affixed to it.

As shown principally in FIGS. 2–4, 7 and 8, the lower frame member 32 for the bag housing is preferably an injection molded plastic member. It is of a prescribed geometric shape having substantial width and length so that the bag will be made to assume the shape of a rectangular tank. The frame member 32 includes front and rear retainer band guide rails 94 and 96, respectively. These rails are spaced a distance from the outer walls of the frame member slightly greater than the thickness of the retainer band and are thereby adapted to hold the retainer band along the inner wall of the frame member 32. Likewise, the lower frame member includes a plurality of guide posts 98 located at the corners of the frame member and serving the same purpose as the guide rails 94,96 for locating the retainer band 90 relative to the lower frame member. On the inboard wall surface of the lower frame member is located a plurality of retainer clips 100 (the front two retainer clips being shown in FIG. 2 in dotted line). These retainer clips are adapted to snap over the top edge of the retainer band when the retainer band and bag housing assembly are fitted down into the lower frame member.

The upper rest member 26 also includes similar guide rails 94,96 and guide posts 98 for receiving and securing the upper retainer band 88 and thus the upper end of the bag 86.

The lower frame member also includes a boss 102 having a closed end receptacle 104 for receiving the nozzle 30 of the suction attachment hose. It may also include a pair of locating tabs 106 (FIG. 8) interengaging respective slots in the hood 12 to enhance the lateral stability of the bag housing assembly relative to the cleaner head assembly.

As seen in FIG. 4, the bag 86 includes a zipper 108 running its full length. A filter bag 110 may be inserted or withdrawn from the enclosure within the bag housing assembly by unzipping the bag 86 and sliding the paperboard bag collar 112 of the filter bag 110 over the discharge end of the discharge tube 66 so that the filter bag inlet overlaps and surrounds the discharge end as shown. In a conventional manner forming no part of the present invention, the filter bag inlet is constructed and sized relative to the discharge end such that it will be retained thereon during all manner of operation until the operator pulls it off to replace it with a new filter bag.

Finally, as seen particularly in FIGS. 2 and 5–7, the lower frame member includes a pair of elongate hollow track members 120. These track members are integrally constructed on the lower frame member, all being of the same injection mold, and including a closed bottom (see FIGS. 5 and 6) having a lug 122 for locating a compression coil spring 124 therewithin.

Each follower track member 120 includes a slot 126 to receive the guide ribs 78 and 80 and secure the track member for sliding movement within guide track member 70 with very little play between the members fore and aft and laterally.

Compression spring 124 is located at its top end on lug 128 which is molded integrally with guide ribs 76.

To assemble the bag housing assembly, the lower frame member is first located within guide track members 70 against the bias of spring 124. The assembly is then held in such position, as shown in FIG. 6, by any suitable means while the upper end of the bag assembly is secured to the rest member 26. Thus, the bag housing will be in tension when released against the spring bias.

The bag assembly may stretch during use, however, due to the length of the spring selected, the springs 24 remain under compression and the bag will remain in tension during cleaning operations and when in storage.

Thus, during operation, it will be seen that the bag housing assembly will constantly be in tension due to compression of the spring 124. Further, since the individual pairs of interengaging track members 70,120 together define a pair of laterally spaced reciprocating track sets located on each side of the handle member 60, the entire bag assembly will be precluded from twisting about the axis of the operator handle 20, and will be otherwise permanently affixed to the handle other than the sliding elongation along the length of the bag which is permitted by the track sets under the action of springs 124.

While the best mode for carrying out the invention has been described in detail, those familiar with the art to which this invention relates will recognize various alternative designs and embodiments for practicing the invention as defined by the following claims.

What is claimed is:

1. An upright-type vacuum cleaner comprising a suction-generating means having an inlet end and a discharge end, a dirt collecting bag housing assembly at the discharge end of said suction-generating means a cleaner head assembly having a chassis and a hood mounted thereon, said chassis defining a chamber for a rotary agitator and an air passageway for communicating dirt-laden air between the chamber and the inlet end of said suction-generating means;

an operating handle for maneuvering the cleaner pivotally connected to the chassis and carrying the bag housing assembly;

said operating handle including a duct member for conveying dirt-laden air under positive pressure from the discharge end of said suction generating means to an upper portion of said handle, said duct member having a discharge port at the upper portion of said handle;

said bag housing assembly including a flexible bag housing adapted to receive a filter bag having an inlet port to receive the discharge port of said duct member;

said bag housing assembly being substantially fixed at its upper end to the upper portion of said handle and including suspension means at its lower end for resiliently supporting said bag housing assembly on said handle and maintaining said bag housing assembly in tension;

said suspension means including at least one track member affixed to said bag housing assembly;

said suspension means further including at least one track member affixed to said handle; and one of said track members being guidingly received within the other track member, and a compression spring means biasing said track members from one another whereby said bag housing will be in constant tension and thereby retain its same basic shape during all periods of operation and storage.

2. An upright-type vacuum cleaner comprising a suction-generating means having an inlet end and a discharge end, a dirt collecting bag housing assembly at the discharge end of said suction-generating mans and a cleaner head assembly having a chassis and a hood mounted thereon, said chassis defining a chamber for a rotary agitator and an air passageway for communicating dirt-laden air between the chamber and the inlet end of said suction-generating means;

an elongate operating handle for maneuvering the cleaner pivotally connected to the chassis and carrying the bag housing assembly;

said operating handle including a duct member for conveying dirt-laden air under positive pressure from the discharge end of said suction generating means to an upper portion of said handle, said duct member having a discharge port at the upper portion of said handle;

said bag housing assembly including a flexible bag housing adapted to receive a filter bag having an inlet port to receive the discharge port of said duct member;

said bag housing assembly being substantially fixed at its upper end to the upper portion of said handle and including suspension means at its lower end for resiliently supporting said bag housing assembly on said handle and maintaining said bag housing assembly in tension;

said bag housing including a flexible perforate bag permanently affixed to a rigid upper frame member and being secured a its lower end to the periphery of a rigid lower frame member of a geometric shape having substantial width and length whereby the bag will assume substantially the same geometric shape and will provide within the bag enclosure a chamber for receiving a filter bag.

3. The invention as in claim 2 wherein said bag includes a zipper extending substantially the full length thereof for providing access to the interior of the bag to allow inserting within and withdrawing from the interior thereof a filter bag.

4. The invention as in claim 2 wherein said lower frame member includes a pair of laterally disposed suspension track members and said handle includes a pair of laterally disposed suspension track members;

the track members on said handle being aligned with and telescopically receiving the track members on said lower frame member to provide a pair of suspension track sets; and a compression spring means biasing the respective track members of each suspension track set from one another whereby the bag housing will be in constant tension and thereby retain its same basic shape during all periods of operation and storage.

5. The invention of claim 4 wherein within each suspension track set one of said track members is an elongate hollow follower track member extending in the direction of the longitudinal axis of said handle and being of integral construction with the lower frame member, and the other of said track members is integral with said handle and includes a tubular frame having a base and a plurality of elongate side walls, said follower track member being received within said tubular frame in sliding engagement with said side walls whereby the lateral position and the fore-and-aft position of the bag is fixed relative to the handle;

said compression spring means being a single compression coil spring received at one end within the hollow track member, and bearing against said base at its other end and being compressed, thereby placing said bag housing in tension.

6. The invention of claim 4 wherein said suspension track sets are located on opposite sides of said handle and are laterally disposed from one another a distance substantially equal to the width of the lower frame member, thereby providing significant lateral stability precluding any twisting of the bag housing.

7. The invention of claim 2 wherein said handle includes a hose support member at its upper end for supporting a suction attachment hose, and said upper frame member being affixed to said handle immediately below and in contiguous relation to said hose support member to present the streamlined appearance of a single upper member.

8. The invention of claim 2 wherein said bag includes a relatively rigid, deformable retainer band secured to its lower end about the circumference thereof, said bag being open at its lower end;

said bag housing lower frame member including a plurality of guide members spaced about the circumference thereof for receiving said retainer band and maintaining the shape of said retainer band in conformance with the geometric shape of said lower frame member; and means for securing the retainer band to said lower frame member.

9. The invention of claim 8 wherein said retainer band includes a plurality of securement members spaced about the circumference thereof;

said guide members including a plurality of securement members adapted to lock with a respective one of said retainer band securement members when the retainer band is forced onto the guide members.

* * * * *